US012264287B2

(12) United States Patent
Wu et al.

(10) Patent No.: US 12,264,287 B2
(45) Date of Patent: Apr. 1, 2025

(54) PENTANE-ENRICHED HYDROCARBONS TO TRANSPORTATION FUEL

(71) Applicant: PHILLIPS 66 COMPANY, Houston, TX (US)

(72) Inventors: Chengtian Wu, Bartlesville, OK (US); Jonathan Marda, Baton Route, LA (US); Karthikeyan Marimuthu, Bartlesville, OK (US); Dhananjay Ghonasgi, Bartlesville, OK (US); Jianhua Yao, Bartlesville, OK (US)

(73) Assignee: Phillips 66 Company, Houston, TX (US)

( * ) Notice: Subject to any disclaimer, the term of this patent is extended or adjusted under 35 U.S.C. 154(b) by 45 days.

(21) Appl. No.: 18/314,613

(22) Filed: May 9, 2023

(65) Prior Publication Data

US 2023/0365878 A1 Nov. 16, 2023

Related U.S. Application Data

(60) Provisional application No. 63/342,344, filed on May 16, 2022, provisional application No. 63/342,352, filed on May 16, 2022.

(51) Int. Cl.

| | |
|---|---|
| ***C10G 67/16*** | (2006.01) |
| ***C10G 35/06*** | (2006.01) |
| ***C10G 50/00*** | (2006.01) |

(52) U.S. Cl.
CPC ..... *C10G 67/16* (2013.01); *C10G 35/065* (2013.01); *C10G 50/00* (2013.01); *C10G 2300/1081* (2013.01); *C10G 2300/30* (2013.01); *C10G 2400/02* (2013.01)

(58) Field of Classification Search
CPC ..... C10G 2300/1081; C10G 2300/30; C10G 2400/02; C10G 35/065; C10G 50/00; C10G 67/16; C10L 1/06
See application file for complete search history.

(56) References Cited

U.S. PATENT DOCUMENTS 8,921,629 B2 * 12/2014 Powell ..... C10M 169/04 585/242
10,988,696 B2 * 4/2021 Baldridge ..... C10G 65/043

* cited by examiner

*Primary Examiner* — Ellen M McAvoy
*Assistant Examiner* — Chantel Graham
(74) *Attorney, Agent, or Firm* — Phillips 66 Company

(57) ABSTRACT

Methods that increase production of a liquid transportation fuel blend component by utilizing C5 hydrocarbon streams taken from both a refinery naphtha stream and an NGL fractionator pentanes plus stream. A high vapor pressure pentane fraction from the NGL fractionator is separated to remove isopentane and produce lower vapor pressure commodity natural gasoline. A refinery naphtha stream (that is optionally an FCC naphtha stream) is separated to produce a C5 olefins stream that is then oligomerized to produce an upgraded stream having lower vapor pressure and higher octane rating, then combined with the remainder of the naphtha stream as well as the isopentane stream to produce a gasoline blend component that meets specifications for vapor pressure and octane rating.

20 Claims, 3 Drawing Sheets

PENTANE-ENRICHED HYDROCARBONS TO TRANSPORTATION FUEL

CROSS-REFERENCE TO RELATED APPLICATIONS

This application is a non-provisional application which claims the benefit of and priority to U.S. Provisional Application Ser. No. 63/342,344 filed May 16, 2022, entitled "Pentane-Enriched Hydrocarbons to Transportation Fuel," and U.S. Provisional Application Ser. No. 63/342,352 filed May 16, 2022, entitled "Systems for Pentane-Enriched Hydrocarbons to Transportation Fuelrocarbons to Transportation Fuel" both of which are hereby incorporated by reference in its entirety.

STATEMENT REGARDING FEDERALLY SPONSORED RESEARCH OR DEVELOPMENT

None.

FIELD OF THE INVENTION

The present disclosure relates to processes and systems that increases production of a liquid transportation fuel (or a liquid transportation fuel blend component) from pentane enriched fractions obtained from both a refinery FCC and an NGL fractionator. A pentanes plus predominantly comprising hydrocarbons containing five and six carbon atoms is obtained from an NGL fractionator and separated to remove isopentane, thereby lowering the vapor pressure of the natural gasoline. A C5 olefins stream separated from refinery FCC naphtha stream is oligomerized to produce an oligomerized stream with lower vapor pressure. The processes and systems produce hydrocarbons suitable for use as a blend component of a liquid transportation fuel.

BACKGROUND

A large surplus of pentanes are available in the petroleum refining industry, arising predominantly from the increased production of light hydrocarbons from U.S. shale formations, and also from limits on the quantity of volatile components that can be blended into finished transportation fuels as well as high quality NGL streams, which must adhere to regulations on maximum vapor pressure.

Commercial-scale fractionation of NGL streams often produces a natural gasoline fraction (comprising C5-C6 alkanes) having a Reid vapor pressure (RVP) that is greater than allowed by government specifications for a commodity natural gasoline (e.g., 12 psi), which significantly decreases the value of the natural gasoline stream. It would be beneficial to find improved processes and systems for efficiently upgrading the market value of such off-spec natural gasoline streams as well as increase the total quantity of refinery-derived C5 hydrocarbons that can be blended into liquid hydrocarbon transportation fuels such as gasoline.

The inventive processes disclosed herein provide an improved upgrading route for pentane-rich fuel blend-stocks and other pentane-rich streams that do not meet government specifications for a transportation fuel. The inventive processes and systems provide enhanced yields of upgraded products that may be suitable for use as transportation fuels or other chemical commodities.

BRIEF SUMMARY OF THE DISCLOSURE

Some embodiments comprise a method for converting a hydrocarbon feed stream comprising pentanes to produce a liquid transportation fuel blend stock, comprising: a) providing a natural gas liquids feed stream comprising C2-C6 hydrocarbons; b) separating the natural gas liquids feed stream in a fractionator to produce multiple fractions, each fraction comprising a light hydrocarbon containing from 2 to 5 carbon atoms, wherein one of the fractions is a raw natural gasoline fraction comprising at least 70 wt % of hydrocarbons containing five or six carbon atoms, wherein the raw natural gasoline fraction has a Reid vapor pressure that exceeds 12 psi; c) separating the natural gasoline fraction to produce an isopentane fraction comprising at least 60 mol % of the isopentane in the raw natural gasoline fraction and a natural gasoline product predominantly comprising hydrocarbons containing 5 or 6 carbon atoms, wherein the natural gasoline product has a Reid vapor pressure that is less than 12 psi; d) splitting a refinery-derived naphtha stream comprising C4-C10 hydrocarbons to produce a C5 olefins fraction that is enriched in olefins containing five carbon atoms, and a low olefin naphtha stream that is depleted in C5 olefins and meets specifications for a blend component of gasoline; e) contacting the C5 olefins fraction with an oligomerization catalyst at conditions of temperature and pressure that facilitate the conversion of the isomerization effluent to produce an oligomerization effluent comprising an increased percentage of aliphatic hydrocarbons (in wt. %) containing from six to ten carbon atoms, relative to the aliphatic hydrocarbons content (in wt. %) of the activation effluent; f) combining the oligomerization effluent, the isopentane fraction of c) and the low olefin naphtha stream of d) in a ratio that produces a hydrocarbon product that meets regulatory specifications for gasoline, or a blend component thereof.

Some embodiments comprise a method for converting a hydrocarbon feed stream comprising pentanes to produce a liquid transportation fuel blend stock, comprising: a) providing a natural gas liquids feed stream comprising C2-C6 hydrocarbons; b) separating the natural gas liquids feed stream in a fractionator to produce multiple fractions, each fraction comprising a light hydrocarbon containing from 2 to 5 carbon atoms, wherein one of the fractions is a raw natural gasoline fraction comprising at least 70 wt % of hydrocarbons containing five or six carbon atoms, wherein the raw natural gasoline fraction has a Reid vapor pressure exceeding 12 psi; c) separating the natural gasoline fraction to produce an isopentane fraction comprising at least 60 mol % of the isopentane in the raw natural gasoline fraction and a natural gasoline product predominantly comprising hydrocarbons containing 5 or 6 carbon atoms, wherein the natural gasoline product has a Reid vapor pressure of less than 12 psi; d) splitting a refinery-derived naphtha stream to produce a C5 olefins fraction that is enriched in olefins containing five carbon atoms, and a low olefin naphtha stream that is depleted in C5 olefins that meets specifications for a blend component of a liquid transportation fuel; e) contacting the C5 olefins fraction with one or more isomerization catalysts in an isomerization catalyst bed that is maintained at a temperature and a pressure that facilitates the catalytic isomerization of at least a portion of the C5 olefins in the C5 olefins fraction to produce isopentane, thereby producing an isomerization effluent having an increased ratio of isopentenes to n-pentene (on a wt. % basis) relative to the isopentenes to n-pentene ratio of the C5 olefins fraction; f) oligomerizing the isomerization effluent by contacting it with an oligomerization catalyst at conditions of temperature and pressure that facilitate the conversion of the isomerization effluent to produce an oligomerization effluent comprising an increased percentage of aliphatic hydrocarbons (in wt. %) containing from six to ten carbon atoms, relative to the aliphatic hydrocarbons content (in wt. %) of the activation effluent; g) combining the oligomerization effluent, the isopentane fraction of c) and the low olefin naphtha stream of d) in a ratio that produces a hydrocarbon product that meets government specifications for a liquid transportation fuel, or a blend component thereof.

In some embodiments of the method, the separating of the natural gasoline fraction is performed by a deisopentanizer. In some embodiments of the method, the separation of the naphtha stream is performed using at least one separation technology selected from distillation, extractive distillation, solvent extraction and selective membrane separation. In some embodiments of the method, the naphtha stream is derived from the effluent of a fluidized catalytic cracking unit.

In some embodiments of the method, at least 30 wt. % of the olefins in the C5 olefins stream are oligomerized by the oligomerization catalyst in the oligomerization reactor.

In some embodiments of the method, the separating of the natural gasoline fraction is performed by a deisopentanizer. In some embodiments of the method, the splitting of the naphtha stream is performed using at least one separation technology selected from distillation, extractive distillation, solvent extraction and selective membrane separation.

In some embodiments of the method, the refinery-derived naphtha stream is derived from the effluent of a fluidized catalytic cracking unit. In some embodiments of the method, the natural gas liquids feed stream is comprised of at least 90 wt. % alkanes that contain from 2 to 6 carbon atoms. In some embodiments of the method, at least 50 wt % of the olefins in the isomerization effluent are oligomerized by the oligomerization catalyst in the oligomerization reactor.

In some embodiments of the method, the oligomerization catalyst comprises solid phosphoric acid. In some embodiments of the method, the isomerization catalyst comprises ferrierite.

Some embodiments comprise a system for producing gasoline or a blend component thereof, comprising: a) at least one NGL fractionator operable to separate natural gas liquids by distillation to produce at least one fraction comprising C2-C4 hydrocarbons and a pentanes plus fraction comprising C5-C6 alkanes; b) a deisopentanizer operable to receive the pentanes plus fraction and to separate isopentane from the pentanes plus fraction to produce an isopentane stream and a natural gasoline stream that has a decreased Reid vapor pressure than the pentanes plus stream; c) a separator operable to separate a naphtha stream comprising C4-C10 hydrocarbons to produce a C5 olefins stream that is enriched in olefins containing five carbon atoms relative to the naphtha stream, and a low olefin naphtha stream comprising C5 alkanes as well as olefins, naphthenes and aromatics that contain from six to eight carbon atoms; d) an oligomerization reactor that contains an oligomerization catalyst and is operable to receive the C5 olefins stream and to maintain conditions of temperature and pressure that facilitate catalytic conversion of olefins in the C5 olefins stream to produce an oligomerization effluent comprising C5-C10 hydrocarbons that has a lower Reid vapor pressure relative to the C5 olefins stream and an octane rating that meets specifications for a gasoline fuel; e) a gasoline blending pool operable to receive the combined isopentane stream, oligomerization effluent and low olefin naphtha stream.

Some embodiments comprise a system for producing gasoline or a blend component thereof, comprising: a) at least one NGL fractionator operable to separate natural gas liquids by distillation to produce at least one fraction comprising C2-C4 hydrocarbons and a pentanes plus fraction comprising C5-C6 alkanes; b) a deisopentanizer operable to receive the pentanes plus fraction and to separate isopentane from the pentanes plus fraction to produce an isopentane stream and a natural gasoline stream that has a decreased Reid vapor pressure than the pentanes plus stream; c) a separator operable to separate a naphtha stream comprising C4-C10 hydrocarbons to produce a C5 olefins stream that is enriched in olefins containing five carbon atoms relative to the naphtha stream, and a low olefin naphtha stream comprising C5 alkanes as well as olefins, naphthenes and aromatics that contain from six to eight carbon atoms; d) an isomerization reactor that contains an isomerization catalyst and is operable to receive the C5 olefins stream and to maintain conditions of temperature and pressure that facilitate catalytic isomerization of olefins in the C5 olefins stream by the isomerization catalyst to produce an isomerization effluent having an increased ratio of isopentane to n-pentene (on a wt. % basis) relative to the isopentane to n-pentene ratio of the C5 olefins fraction; e) an oligomerization reactor that contains an oligomerization catalyst and is operable to receive the isomerization effluent and to maintain conditions of temperature and pressure that facilitate catalytic conversion of olefins in the C5 olefins stream to produce an oligomerization effluent comprising C5-C10 hydrocarbons that has a lower Reid vapor pressure relative to the C5 olefins stream and an octane rating that meets specifications for a gasoline fuel; f) a gasoline blending pool operable to receive a mixture comprising the isopentane stream, the oligomerization effluent and the low olefin naphtha stream.

In some embodiments of the system, the first separator is operable to separate the refinery-derived naphtha stream using at least one separation technology selected from distillation, extractive distillation, solvent extraction and selective membrane separation.

In some embodiments of the system, the naphtha stream is derived from the effluent of a fluidized catalytic cracking unit. In some embodiments of the system, the natural gas liquids fractionator is operable to separate a natural gas liquids feed stream comprised of at least 90 wt. % alkanes that contain from 2 to 6 carbon atoms. In some embodiments of the system, the oligomerization catalyst comprises solid phosphoric acid. In some embodiments of the system, the isomerization catalyst comprises ferrierite.

In some embodiments of the system, the oligomerization reactor is operable to maintain conditions of temperature and pressure the facilitate conversion of at least 50 wt. % of the olefins in the C5 olefins stream are oligomerized by the oligomerization catalyst in the oligomerization reactor.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Figure 1:
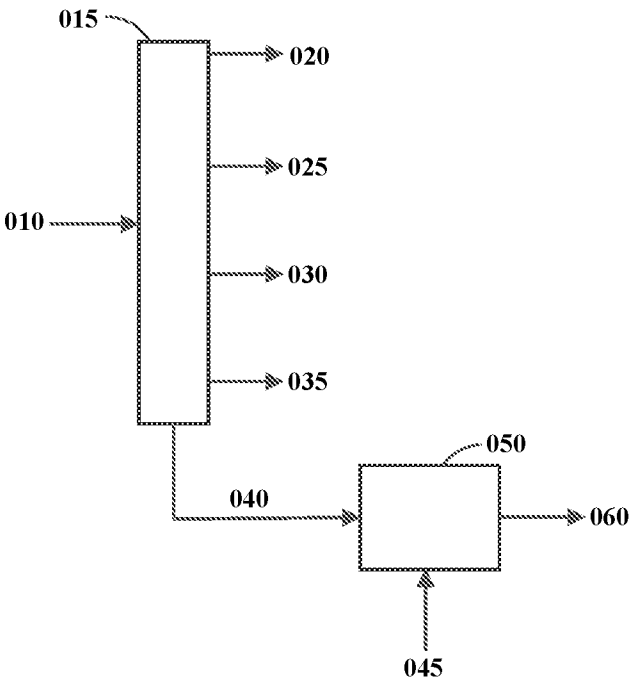
FIG. 1 is a diagram depicting a first embodiment of the inventive processes and systems.

The present disclosure provides processes and systems for converting a mixture of light hydrocarbons to a blend component of a liquid transportation fuel. More specifically, it pertains to the conversion of hydrocarbon mixtures that predominantly comprise C5 hydrocarbons to generate upgraded products that may be sold as a commodity natural gasoline or utilized as a blend component of a liquid transportation fuel. Generally speaking, the inventive processes and systems described herein take advantage of synergies between midstream and refining operations to increase production of products that meet government specifications to be sold as gasoline and natural gasoline.

An issue commonly encountered during the operation of commercial NGL fractionators, is production of a "pentanes plus fraction" (largely comprising C5 and C6 alkanes) having a Reid vapor pressure (RVP) that is too high to meet government specifications for a natural gasoline commodity. The present inventive processes and systems allow more profitable operation of a NGL fractionator by removing components (e.g., isopentane) that have a high RVP from a "pentanes plus fraction" that does not meet vapor pressure specifications (e.g., RVP less than 12 psi). In the present process, the pentanes plus fraction is sent to a deisopentanizer that is formed to be operable to remove at least a portion of the isopentane from the pentanes plus fraction. Generally, the percentage of isopentanes removed is sufficient to lower the RVP of the remainder of the pentanes plus fraction below the maximum RVP specification for a natural gasoline stream. This produces a natural gasoline stream with RVP, 12 psi, which can be sold at a higher price per unit, while the separated isopentane is directed to the gasoline blending pool at the refinery.

Unfortunately, the high RVP of the isopentane fraction limits the quantity of isopentane that can be blended into gasoline, leaving excess unutilized isopentane. The inventive process allows blending of this excess isopentane into gasoline by offsetting the relatively high RVP of the isopentane with the relatively low RVP of an oligomerized effluent stream produced by the process. The oligomerized effluent stream is produced by oligomerizing of a C5 olefins fraction that is separated from a naphtha stream that may be derived from the effluent of a fluidized catalytic cracking (FCC) unit. A third component that offsets the high RVP of the isopentane stream is a stream comprising the remainder of the naphtha stream from which the C5 olefins fraction was derived. The three streams are combined in a ratio to that provides a gasoline blend component that meets government specifications for a gasoline transportation fuel. The inventive process and systems increase overall monetary profit from both refinery and NGL fractionator operation by increasing the value of both the produced natural gasoline stream and the isopentane stream that are produced by the NGL fractionator, while also upgrading C5 light olefins derived from FCC naphtha.

For comparative purposes, the flow diagram of FIG. 1 illustrates a conventional, non-inventive, arrangement for blending a pentanes plus fraction from an NGL fractionator into the gasoline blending pool at a commercial refinery when that pentanes plus fraction does not meet vapor pressure specifications to be sold as a natural gasoline commodity. In the conventional arrangement, a natural gas liquids (NGL) feed stream 010 is received into a natural gas fractionator 015 where the NGL feed stream 010 is separated by conventional mechanisms (e.g., distillation, etc.) to produce multiple fractions distributed by carbon number including, for example, ethane 020, propane, 025, isobutane 030, n-butane 035 and a pentanes plus fraction 040 comprising at least 90 wt. % hydrocarbons that contain five or six carbon atoms, plus some larger hydrocarbons. Notably, in the embodiment depicted in FIG. 1, the pentanes plus fraction 040 has an RVP that exceeds the upper limit for a high grade natural gasoline commodity as defined by specifications promulgated either by the government or an applicable trade association (e.g., the Gas Processors Association).

The off-spec pentanes plus fraction 040 (RVP=14.7 psi) is conveyed to a blender 050 where it is mixed with a heavy naphtha fraction 045 (RVP=1.5 psi) at a ratio that produces a natural gasoline 060 that meets RVP specifications for a high grade natural gasoline commodity (i.e., RVP<12 psi). In the example shown, 12 MBPD of an off-spec pentanes plus fraction having an RVP of 14.7 psi must be blended with 3.8 MBPD of a heavy naphtha having an RVP of 1.5 in order to produce 15.8 MBPD of natural gasoline commodity having an RVP of 11.5 psi (well under the less than RVP<12 psi threshold).

Figure 2:
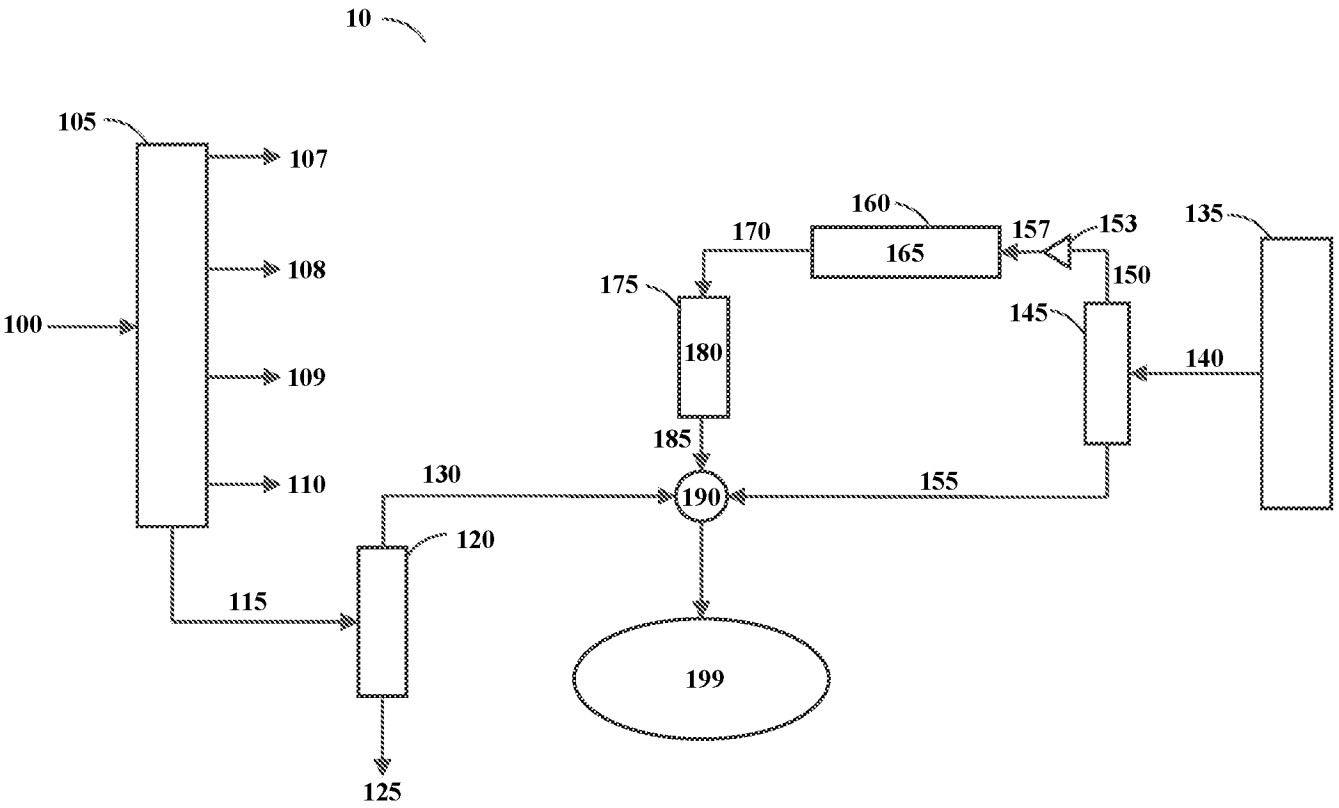
FIG. 2 is a diagram depicting a second embodiment of the inventive processes and systems.

A first embodiment of the inventive processes and systems is illustrated by the process flow-diagram of FIG. 2. The system 10 for upgrading C5 hydrocarbons comprises first receiving a natural gas liquids (NGL) feed stream 100 into a natural gas fractionator 105 where the NGL feed stream 100 is separated by conventional mechanisms (e.g., distillation, etc.) to produce multiple fractions distributed by carbon number including, for example, ethane 107, propane, 108, isobutane 109, n-butane 110 and pentanes plus fraction 115 comprising at least 90 wt. % hydrocarbons containing five or six carbon atoms plus some larger hydrocarbons. Notably, in the embodiment depicted in FIG. 2, the pentanes plus fraction 115 has an RVP that exceeds the upper limit for a high grade natural gasoline commodity as defined by specifications promulgated either by the government or an applicable trade association (e.g., the Gas Processors Association).

The pentanes plus fraction 115 is conveyed to a deisopentanizer 120 that separates the pentanes plus fraction by conventional mechanisms (e.g., distillation, etc.) such that at least a portion of the isopentane that is present in the pentanes plus fraction 115 is separated to produce a natural gasoline product 125 having an RVP less than 12 psi. that can be sold as a high grade natural gasoline commodity. Deisopentanizer 120 further produces an isopentane stream 130 predominantly comprising isopentane.

Further referring to the flow diagram of FIG. 2, a fractionator 135 of a fluidized catalytic cracking (FCC) unit (not depicted) separates an FCC effluent (not depicted) by conventional mechanisms (e.g., distillation, etc.) to produce an FCC naphtha stream 140 that comprises alkanes, olefins, naphthenes and aromatics that contain from five to ten carbon atoms. The FCC naphtha stream 140 is directed to a first separator 145, that separates the FCC naphtha stream 140 using conventional separation technology (such as, but not limited to distillation, extractive distillation, solvent extraction, selective membrane separation, etc.) to produce a C5 olefins stream 150 that is enriched in olefins containing five carbon atoms (relative to the FCC naphtha stream), and a low olefin naphtha stream 155 comprising C5 alkanes as well as olefins, naphthenes and aromatics that contain from six to ten carbon atoms.

The C5 olefins stream 150 leaves the first separator 145 and is conveyed to a compressor 153 that is operable to receive and condense the C5 olefins stream 150 to a pressure that facilitates catalytic isomerization and oligomerization reactions, thereby producing a compressed C5 olefins stream 157.

The compressed C5 olefins stream 157 is directed to an isomerization reactor 160 containing an isomerization catalyst 165. The isomerization reactor 160 receives the C5 olefins stream and maintains conditions of temperature and pressure in the isomerization reactor that facilitate catalytic isomerization of at least a portion of the olefins in the compressed C5 olefins stream 157 to produce an isomerized olefins stream 170 comprising isomerized olefins. Without being bound to theory, isomerization of olefins in the compressed C5 olefins stream is believed to catalytically convert at least apportion of cis olefins to trans olefins and convert at least a portion of terminal olefins to internal olefins via double bond migration. Although utilization of an isomerization reactor is an optional component of the present inventive processes and systems, we have empirically determined that isomerization of the C5 olefins stream increases the overall octane rating of the isomerized olefin stream 170 that is produced in the isomerization reactor 160.

The isomerized olefins stream 170 is conveyed to an oligomerization reactor 175 that contains an oligomerization catalyst 180. The oligomerization reactor 175 receives the isomerized olefins stream 170 and maintains conditions of temperature and pressure in the oligomerization reactor that facilitate catalytic oligomerization of at least a portion of the olefins in the isomerized olefins stream 170 to produce an oligomerization effluent stream 185 comprising an increased quantity of hydrocarbon molecules that are characterized by a boiling-point in the range of a liquid transportation fuel (e.g., gasoline and diesel) and having an increased octane rating and a decreased RVP relative to the isomerized olefins stream 170.

The low olefin naphtha stream 155, the oligomerization effluent stream 185 and the isopentane stream 130 are combined in a ratio such that both the octane rating and RVP for the combined streams meets government octane rating and RVP specifications for a finished gasoline fuel (or alternatively, a gasoline blend component), thereby producing gasoline blend component 190. Typically, this means that the high RVP of the isopentane stream 130 is offset by the lower RVP of the low olefin naphtha stream 155 and the oligomerization effluent stream 185, while the relatively high octane rating of the isopentane stream 130 and oligomerization effluent stream 185 can offset the lower octane of the naphtha stream 155. Gasoline blend component 190 is then conveyed to gasoline blending pool 199.

Figure 3:
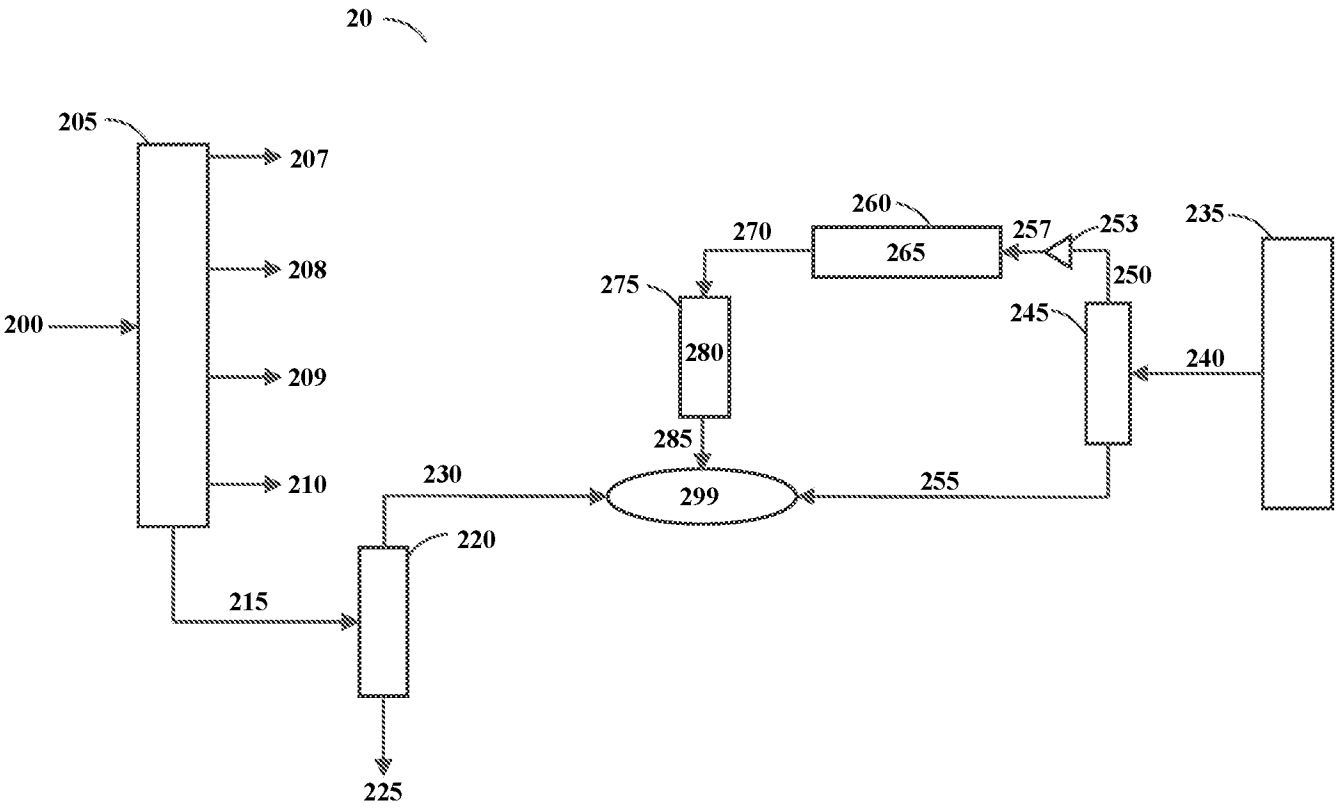
FIG. 3 is a diagram depicting a third embodiment of the inventive processes and systems.

A second embodiment of the inventive processes and systems is illustrated by the process flow-diagram of FIG. 3. The system 20 for upgrading C5 hydrocarbons comprises first receiving a natural gas liquids (NGL) feed stream 200 into a natural gas fractionator 205 where the NGL feed stream 200 is separated by conventional mechanisms (e.g., distillation, etc.) to produce multiple fractions distributed by carbon number including, for example, ethane 207, propane, 208, isobutane 209, n-butane 210 and a pentanes plus fraction 215 comprising at least 90 wt. % hydrocarbons containing five or six carbon atoms plus some larger hydrocarbons. Notably, in the embodiment depicted in FIG. 3, the pentanes plus fraction 215 has an RVP that exceeds the upper limit for a high grade natural gasoline commodity as defined by specifications promulgated either by the government or an applicable trade association (e.g., the Gas Processors Association).

The pentanes plus fraction 215 is conveyed to a deisopentanizer 220 that separates the pentanes plus fraction by conventional mechanisms (e.g., distillation, etc.) such that at least a portion of the isopentane that is present in the pentanes plus fraction 215 is separated to produce a natural gasoline product 225 having an RVP less than 12 psi. that can be sold as a high grade natural gasoline commodity. Deisopentanizer 220 further produces an isopentane stream 230 comprising predominantly isopentane.

Further referring to the flow diagram of FIG. 3, a fractionator 235 of a fluidized catalytic cracking (FCC) unit (not depicted) separates an FCC effluent (not depicted) by conventional mechanisms (e.g., distillation, etc.) to produce an FCC naphtha stream 240 that comprises alkanes, olefins, naphthenes and aromatics that contain from five to ten carbon atoms. The FCC naphtha stream 240 is directed to a first separator 245 that separates the FCC naphtha stream 240 using conventional separation technology (such as, but not limited to distillation, extractive distillation, solvent extraction, selective membrane separation, etc.) to produce a C5 olefins stream 250 that is enriched in olefins containing five carbon atoms (relative to the FCC naphtha stream), and a low olefin naphtha stream 255 comprising C5 alkanes as well as olefins, naphthenes and aromatics that contain from six to ten carbon atoms.

The C5 olefins stream 250 leaves the first separator 245 and is conveyed to a compressor 253 that is operable to receive and condense the C5 olefins stream 250 to a higher pressure that facilitates catalytic isomerization and oligomerization reactions, thereby producing a compressed C5 olefins stream 257. Some embodiments do not include a compressor, although the isomerization and oligomerization conversion that occur in the reactors located downstream from the compressor are generally improved when conducted at higher pressures.

The compressed C5 olefins stream 257 is directed to an isomerization reactor 260 containing an isomerization catalyst 265. The isomerization reactor 260 receives the C5 olefins stream and maintains conditions of temperature and pressure in the isomerization reactor that facilitate catalytic isomerization of at least a portion of the olefins in the compressed C5 olefins stream 257 to produce an isomerized olefins stream 270 comprising isomerized olefins. Without being bound to theory, isomerization of olefins in the compressed C5 olefins stream is believed to catalytically convert at least apportion of cis olefins to trans olefins and convert at least a portion of terminal olefins to internal olefins via double bond migration. Although utilization of an isomerization reactor is an optional component of the present inventive processes and systems, we have empirically determined that isomerization of the C5 olefins stream increases the overall octane rating of the isomerized olefin stream 270 that is produced in the isomerization reactor 260.

The isomerized olefins stream 270 is conveyed to an oligomerization reactor 275 that contains an oligomerization catalyst 280. The oligomerization reactor 275 receives the isomerized olefins stream 270 and maintains conditions of temperature and pressure in the oligomerization reactor that facilitate catalytic oligomerization of at least a portion of the olefins in the isomerized olefins stream 270 to produce an oligomerization effluent stream 285 comprising an increased quantity of hydrocarbon molecules that are characterized by a boiling-point in the range of a liquid transportation fuel (e.g., gasoline and diesel) and having an increased octane rating and a decreased RVP relative to the isomerized olefins stream 270.

The low olefin naphtha stream 255, the oligomerization effluent stream 285 and the isopentane stream 230 are all conveyed to gasoline blending pool 299 in a ratio such that the arithmetic mean of both the octane rating and RVP for the three streams (optionally, together with other blending streams such as reformate) meets regulatory specifications for a gasoline transportation fuel. This means that the high RVP of the isopentane stream 230 is offset by the lower RVP of the low olefin naphtha stream 255 and the oligomerization effluent stream 285, while the relatively high octane rating of the isopentane stream 230 and oligomerization effluent stream 285 can offset the lower octane of the naphtha stream 255.

Speaking generally, the isomerization reactor contains an isomerization catalyst and is operable to maintain a temperature and a pressure that facilitates the isomerization of at least a portion of the C5 olefins by the isomerization catalyst. Speaking generally, the isomerization process is designed primarily for continuous catalytic isomerization of the olefins present in the C5 olefins fraction. In certain embodiments, the isomerization catalyst may comprise more than one isomerization catalyst. Optionally, isomerization may be conducted in more than one isomerization reactor arranged in series configuration, with each reactor containing a different isomerization catalyst (or mixture of isomerization catalysts). Each isomerization reactor maintains a partial pressure of hydrogen and operating conditions of temperature and pressure in the isomerization reaction zone that facilitate isomerization by the isomerization catalyst while minimizing hydrocracking.

Generally speaking, the isomerization catalyst may comprise any known isomerization catalyst. Currently, three basic families of light naphtha isomerization catalysts are known. The first are termed super-acidic catalysts such as, for example, chlorinated alumina catalysts with platinum. Super acidic isomerization catalysts are highly active and have significant activity at temperatures as low as 265° F. (130° C.) using a lower H2/HC ratio (less than 0.1 at the outlet of the reactor). However, maintaining the high acidity of these catalysts requires the addition of a few ppm of chloriding agent to the feedstock. At the inlet of the isomerization reactor, this chloriding agent reacts with hydrogen to form HCl, which inhibits the loss of chloride from the catalyst. Unlike a zeolitic catalyst, the acidic sites on a super-acidic catalyst are irreversibly deactivated by water. These catalysts are also sensitive to sulfur and oxygenate contaminants, so the feed stream is generally hydrotreated and dried to remove residual water contamination. Commercially-available examples of chlorided-alumina catalysts include, but are not limited to, IS614A, AT-2, AT-2G, AT-10 and AT-20 (by Akzo Nobel) and ATIS-2L (by Axens). Due to their chlorinated nature, these are very sensitive to feed impurities, particularly water, elemental oxygen, sulfur, and nitrogen. When using such super-acidic catalysts, the reactor operating temperature generally ranges from 14° C. to 175° C., while the operating pressure is generally in the range from 200 psig to 600 psig, preferably in the range from 425 psig to 475 psig.

Zeolitic isomerization catalysts require a higher operating temperature and are effective at isomerization at temperatures ranging from 220° C. to about 315° C., preferably at a temperature ranging from 230° C. to 275° C. Pressures utilized for isomerization with zeolitic isomerization catalysts typically range from 300 psig to 550 psig with a LHSV from 0.5 to 3.0 $hr^{-1}$. These catalysts react as bifunctional catalysts and require hydrogen at a $H_2$/HC ratio ranging from about 1.5 to about 3. Zeolitic catalysts have advantages over chlorided-alumina catalysts due to zeolitic catalyst tolerance for typical catalyst poisons sulfur, oxygenates and water. Zeolitic catalysts also do not require the injection of a chloriding agent in order to maintain catalyst activity.

A third type of conventional isomerization catalyst that may be useful in certain embodiments comprises sulfated zirconia/metal oxide catalysts. These catalysts are active at relatively low temperatures (e.g., 100° C.) with the advantage of providing enhanced isoparaffin yield. Their biggest drawback is their relative sensitivity to catalyst poisons, especially water. Certainly, other examples of isomerization catalysts that are suitable for use with the present processes and systems described herein are known by those having experience in the field, and thus, require no further disclosure here.

Speaking generally, the oligomerization catalyst may comprise any solid catalyst (or mixture of catalysts) characterized as possessing either Brønsted or Lewis acidic properties. In certain embodiments, the oligomerization catalyst is a zeolite or mixture of zeolites, or a reactive transition metal oxide. In certain embodiments, the oligomerization catalyst is ZSM-5, although many zeolites are well-characterized as possessing oligomerization properties and may be suitable for use (either alone or in combination) with the inventive processes and systems described herein. Other well-characterized oligomerization catalysts include, but are not limited to: nickel oxides, aluminum alkyls, aluminum halides, perfluoroaryl boranes, oligomeric methyl aluminoxanes (including supported), perfluoroaryl boranes, fluoroarylanes, trityl borate, ammonium borate (and aluminate salts thereof), supported PhNMe2H+B(C6F5)4- and borate anions and superacidic solid Brønsted acids, among others.

The oligomerization reactor is operable to maintain at a temperature and pressure suitable to facilitate oligomerization of olefins present in the gaseous activation effluent, thereby producing larger hydrocarbons comprising at least six carbons that are preferably characterized by a boiling point that is in the boiling point range of a liquid transportation fuel (e.g., gasoline or diesel). The oligomerization reactor is generally maintained at a total pressure in a range from 14 psia to 800 psia, optionally in the range from 50 psia to 300 psia. The oligomerization reactor is typically maintained at a temperature (measured within the oligomerization reactor inlet) in the range from 175° C. to 420° C., optionally in the range from 175° C. to 350° C. Typically, flow thorough the oligomerization reactor is maintained at a weight hourly space velocity (WHSV) in the range from 0.5 $hr^{-1}$ to 10 $hr^{-1}$. Optionally, the WHSV is in the range from 0.5 $hr^{-1}$ to 2.0 $hr^{-1}$. While higher overall throughput is desirable, ideally the chosen WHSV allows for conversion of at least 85% of olefins present in the C5 olefins stream at the selected operating temperature and pressure.

The catalytic conversion occurring in the oligomerization reactor produces an oligomerization effluent that typically comprises an increased quantity of hydrocarbon molecules that are characterized by a boiling-point in the range of a liquid transportation fuel (e.g., gasoline). Preferably, the combination of isomerization, and oligomerization converts at least 30 wt. % of the C5 olefins stream to hydrocarbon molecules that are characterized by a boiling point that is in the boiling point range of gasoline and to hydrocarbon molecules having an octane rating that meets specifications for a liquid hydrocarbon transportation fuel.

EXAMPLES

The following examples are representative of certain embodiments of the inventive processes and systems disclosed herein. However, the scope of the invention is not intended to be limited to the embodiment specifically disclosed. Rather, the scope is intended to be as broad as is supported by the complete disclosure and the appending claims.

Example 1

Two olefin oligomerization runs were performed: Run 1—high temperature (from 263° F. to 447° F.), and Run 2—low temperature (from 230° F. to 414° F.). The feed stream was a light catalytic naphtha, comprising mostly C5 and C6 compounds with 27 wt. % paraffins, 38 wt. % isoparaffins, 4 wt. % naphthenes and 31 wt. % olefins. The catalyst employed was commercially-available solid phosphoric acid, and fresh catalyst was used for each run. The reactor was packed with 18-20 mesh size catalyst pellets to a catalyst bed height of 9 feet.

For both runs, the oligomerization product comprised 26 wt. % paraffins, 45 wt. % isoparaffins, 7 wt. % naphthenes, 3 wt. % aromatics and 5 wt. % olefins. Thus, about 84% of the olefins in the feed were oligomerized into iso-paraffins with a carbon backbone that ranged in size from C6 to C11. Data indicated that the distillation temperature T10 and T50 remained virtually unchanged between feed and product, yet the T90 change was large. Still the T98 was always less than 437° F., indicating that the oligomerization process did not generate significant quantities of product having a boiling point that was outside of the gasoline boiling point range. For the low temperature oligomerization run, RVP decrease was greater and road octane loss was also decreased.

Example 2

In the inventive embodiment depicted in the flow diagram of FIG. 2, 12 MBPD of an off-spec natural gasoline (RVP=14.7 psi) is split by the deisopentanizer into 8.3 MBPD of a natural gasoline stream (RVP 12 psi) that meets specifications to be sold as a high grade natural gasoline commodity and 3.7 MBPD of an isopentane stream (RVP=11.4 psi). The isopentane stream is blended with two other streams (i.e., an oligomerization product stream and a naphtha stream in order to form a blend component of gasoline that meets vapor pressure and octane rating specifications.

The oligomerization product stream is produced by oligomerizing a C5 olefins stream that is separated from an FCC naphtha stream. To demonstrate the effectiveness of oligomerizing this stream in reducing vapor pressure, a C5 olefins stream was oligomerized over a solid phosphoric acid catalyst (Clariant) at a temperature of 200° C., a weighted hourly space velocity of 3 $hr^{-1}$, and a pressure of 500 psig. Results show that the RVP of the product was 4.55 psi lower than the C5 olefins feed stream while octane rating was unaffected. The significantly lower vapor pressure of the oligomerization product stream enabled it to significantly offset the high vapor pressure of the isopentane stream when combined to make a gasoline blend component.

Example 3

The value of isomerizing the C5 olefins stream prior to oligomerization was examined by contacting the C5 olefins stream with a catalyst comprising ferrierite at a temperature of 410° C. and a pressure of 500 psig with a WHSV of 7-16 $hr^{-1}$. This was immediately followed by oligomerizing the isomerization effluent using the conditions listed in Example 2. This was compared with a second C5 olefins sample that was not isomerized prior to oligomerization. While the octane rating (M+R/2 method) of the C5 olefins feed stream was 91.9, the octane rating of the oligomerization only product was 93.7, while the octane rating of the C5 olefins sample that was both isomerized and oligomerized was 95.0. Clearly, isomerization of the C5 olefins stream is beneficial to the final octane rating of the product and allows additional low octane blend stream to be added to the gasoline blending pool without exceeding the overall vapor pressure specification for gasoline.

In closing, it should be noted that the discussion of any reference is not an admission that it is prior art to the present disclosure, in particular, any reference that may have a publication date after the priority date of this application. Although the systems and processes described herein have been described in detail, it is understood that various changes, substitutions, and alterations can be made without departing from the spirit and scope of the invention as defined by the following claims.

Definitions:

In the present disclosure, the term natural gasoline is defined as a mixture of hydrocarbons, mostly pentanes and hexanes, that is extracted from natural gas and that meets vapor pressure, end-point, and other specifications for natural gasoline set by the Gas Processors Association.

In the present disclosure, the term octane rating is generally defined as the anti-knock index, which is the average of the research octane rating and the motor octane rating.

We claim:

1. A method for converting a hydrocarbon feed stream comprising pentanes to produce a liquid transportation fuel blend stock, comprising:

a) providing a natural gas liquids feed stream comprising C2-C6 hydrocarbons;

b) separating the natural gas liquids feed stream in a fractionator to produce multiple fractions, each fraction comprising a light hydrocarbon containing from 2 to 6 carbon atoms, wherein one of the fractions is a raw natural gasoline fraction comprising at least 70 wt % of hydrocarbons containing five or six carbon atoms, wherein the raw natural gasoline fraction has a Reid vapor pressure that exceeds 12 psi;

c) separating the natural gasoline fraction to produce an isopentane fraction comprising at least 60 mol % of the isopentane in the raw natural gasoline fraction and a natural gasoline product predominantly comprising hydrocarbons containing 5 or 6 carbon atoms, wherein the natural gasoline product has a Reid vapor pressure that is less than 12 psi;

d) splitting a refinery-derived naphtha stream comprising C4-C10 hydrocarbons to produce a C5 olefins fraction that is enriched in olefins containing five carbon atoms, and a low olefin naphtha stream that is depleted in C5 olefins and meets specifications for a blend component of gasoline;

e) contacting the C5 olefins fraction with an oligomerization catalyst at conditions of temperature and pressure that facilitate the conversion of the C5 olefins fraction to produce an oligomerization effluent comprising an increased percentage of aliphatic hydrocarbons (in wt. %) containing from six to ten carbon atoms, relative to the aliphatic hydrocarbons content (in wt. %) of the C5 olefins fraction;

f) combining the oligomerization effluent, the isopentane fraction of c) and the low olefin naphtha stream of d) in a ratio that produces a hydrocarbon product that meets regulatory specifications for gasoline, or a blend component thereof.

2. The method of claim 1, wherein at least 30 wt. % of the olefins in the C5olefins stream are oligomerized by the oligomerization catalyst in the oligomerization reactor.

3. A method for converting a hydrocarbon feed stream comprising pentanes to produce a liquid transportation fuel blend stock, comprising:

a) providing a natural gas liquids feed stream comprising C2-C6 hydrocarbons;

b) separating the natural gas liquids feed stream in a fractionator to produce multiple fractions, each fraction comprising a light hydrocarbon containing from 2 to 6 carbon atoms, wherein one of the fractions is a raw natural gasoline fraction comprising at least 70 wt % of hydrocarbons containing five or six carbon atoms, wherein the raw natural gasoline fraction has a Reid vapor pressure exceeding 12 psi;

c) separating the natural gasoline fraction to produce an isopentane fraction comprising at least 60 mol % of the isopentane in the raw natural gasoline fraction and a natural gasoline product predominantly comprising hydrocarbons containing 5 or 6 carbon atoms, wherein the natural gasoline product has a Reid vapor pressure of less than 12 psi;

d) splitting a refinery-derived naphtha stream to produce a C5 olefins fraction that is enriched in olefins containing five carbon atoms, and a low olefin naphtha stream that is depleted in C5 olefins and meets specifications for a blend component of a liquid transportation fuel;

e) contacting the C5 olefins fraction with one or more isomerization catalysts in an isomerization catalyst bed that is maintained at a temperature and a pressure that facilitates the catalytic isomerization of at least a portion of the C5 olefins in the C5 olefins fraction to produce isopentene, thereby producing an isomerization effluent having an increased ratio of isopentenes to n-pentene (on a wt. % basis) relative to the isopentenes to n-pentene ratio of the C5 olefins fraction;

f) oligomerizing the isomerization effluent by contacting it with an oligomerization catalyst at conditions of temperature and pressure that facilitate the conversion of the isomerization effluent to produce an oligomerization effluent comprising an increased percentage of aliphatic hydrocarbons (in wt. %) containing from six to ten carbon atoms, relative to the aliphatic hydrocarbons content (in wt. %) of the isomerization effluent;

g) combining the oligomerization effluent, the isopentane fraction of c) and the low olefin naphtha stream of d) in a ratio that produces a hydrocarbon product that meets government specifications for a liquid transportation fuel, or a blend component thereof.

4. The method of claim 3, wherein the natural gas liquids feed stream is comprised of at least 90 wt. % alkanes that contain from 2 to 6 carbon atoms.

5. The method of claim 3, wherein the oligomerization catalyst comprises solid phosphoric acid.

6. The method of claim 3, wherein the isomerization catalyst comprises ferrierite.

7. The method of claim 3, wherein at least 50 wt. % of the olefins in the isomerization effluent are oligomerized by the oligomerization catalyst in the oligomerization reactor.

8. A system for producing gasoline or a blend component thereof, comprising:

a) at least one NGL fractionator capable of separating natural gas liquids by distillation to produce at least one fraction comprising C2-C4 hydrocarbons and a pentanes plus fraction comprising C5-C6 alkanes;

b) a deisopentanizer capable of receiving the pentanes plus fraction and to separate isopentane from the pentanes plus fraction to produce an isopentane stream and a natural gasoline stream that has a decreased Reid vapor pressure than the pentanes plus stream;

c) a separator capable of separating a naphtha stream comprising C4-C10 hydrocarbons to produce a C5 olefins stream that is enriched in olefins containing five carbon atoms relative to the naphtha stream, and a low olefin naphtha stream comprising C5 alkanes as well as olefins, naphthenes and aromatics that contain from six to eight carbon atoms;

d) an oligomerization reactor that contains an oligomerization catalyst and is capable of receiving the C5 olefins stream and capable of maintaining conditions of temperature and pressure that facilitate catalytic conversion of olefins in the C5 olefins stream to produce an oligomerization effluent comprising C5-C10 hydrocarbons that has a lower Reid vapor pressure relative to the C5 olefins stream and an octane rating that meets specifications for a gasoline fuel;

e) a gasoline blending pool capable of receiving the combined isopentane stream, oligomerization effluent and low olefin naphtha stream.

9. The system of claim 8, wherein the first separator is capable of separating the refinery-derived naphtha stream using at least one separation technology selected from distillation, extractive distillation, solvent extraction and selective membrane separation.

10. The system of claim 8, wherein the natural gas liquids fractionator is capable of separating a natural gas liquids feed stream comprised of at least 90 wt. % alkanes that contain from 2 to 6 carbon atoms.

11. The system of claim 8, wherein the oligomerization catalyst comprises solid phosphoric acid.

12. The system of claim 8, wherein the isomerization catalyst comprises ferrierite.

13. The system of claim 8, wherein the oligomerization reactor is capable of maintaining conditions of temperature and pressure the facilitate conversion of at least 50 wt. % of the olefins in the C5 olefins stream are oligomerized by the oligomerization catalyst in the oligomerization reactor.

14. A system for producing gasoline or a blend component thereof, comprising:

a) at least one NGL fractionator capable of separating natural gas liquids by distillation to produce at least one fraction comprising C2-C4 hydrocarbons and a pentanes plus fraction comprising C5-C6 alkanes;

b) a deisopentanizer capable of receiving the pentanes plus fraction and capable of separating isopentane from the pentanes plus fraction to produce an isopentane stream and a natural gasoline stream that has a decreased Reid vapor pressure than the pentanes plus stream;

c) a separator capable of separating a naphtha stream comprising C4-C10 hydrocarbons to produce a C5 olefins stream that is enriched in olefins containing five carbon atoms relative to the naphtha stream, and a low olefin naphtha stream comprising C5 alkanes as well as olefins, naphthenes and aromatics that contain from six to eight carbon atoms;

d) an isomerization reactor that contains an isomerization catalyst and is capable of receiving the C5 olefins stream and to maintain conditions of temperature and pressure that facilitate catalytic isomerization of olefins in the C5 olefins stream by the isomerization catalyst to produce an isomerization effluent having an increased ratio of isopentane to n-pentene (on a wt. % basis) relative to the isopentane to n-pentene ratio of the C5 olefins fraction;

e) an oligomerization reactor that contains an oligomerization catalyst and is capable of receiving the isomerization effluent and capable of maintaining conditions of temperature and pressure that facilitate catalytic conversion of olefins in the C5 olefins stream to produce an oligomerization effluent comprising C5-C10 hydrocarbons that has a lower Reid vapor pressure relative to the C5 olefins stream and an octane rating that meets specifications for a gasoline fuel;

f) a gasoline blending pool capable of receiving a mixture comprising the isopentane stream, the oligomerization effluent and the low olefin naphtha stream.

15. The system of claim 14, wherein the first separator is capable of separating the refinery-derived naphtha stream using at least one separation technology selected from distillation, extractive distillation, solvent extraction and selective membrane separation.

16. The system of claim 14, wherein the naphtha stream is derived from the effluent of a fluidized catalytic cracking unit.

17. The system of claim 14, wherein the natural gas liquids fractionator is capable of separating a natural gas liquids feed stream comprised of at least 90 wt. % alkanes that contain from 2 to 6 carbon atoms.

18. The system of claim 14, wherein the oligomerization catalyst comprises solid phosphoric acid.

19. The system of claim 14, wherein the isomerization catalyst comprises ferrierite.

20. The system of claim 14, wherein the oligomerization reactor is capable of maintaining conditions of temperature and pressure the facilitate conversion of at least 50 wt % of the olefins in the C5 olefins stream are oligomerized by the oligomerization catalyst in the oligomerization reactor.

* * * * *